US011105065B2

(12) United States Patent
Glasser et al.

(10) Patent No.: US 11,105,065 B2
(45) Date of Patent: Aug. 31, 2021

(54) LIFT ARM LEVELING SYSTEM

(71) Applicant: Clark Equipment Company, West Fargo, ND (US)

(72) Inventors: David Glasser, Bismarck, ND (US); Daniel J. Krieger, Bismarck, ND (US)

(73) Assignee: CLARK EQUIPMENT COMPANY, West Fargo, ND (US)

( * ) Notice: Subject to any disclaimer, the term of this patent is extended or adjusted under 35 U.S.C. 154(b) by 95 days.

(21) Appl. No.: 16/557,534

(22) Filed: Aug. 30, 2019

(65) Prior Publication Data

US 2020/0071906 A1 Mar. 5, 2020

Related U.S. Application Data

(60) Provisional application No. 62/725,786, filed on Aug. 31, 2018.

(51) Int. Cl.

| | |
|---|---|
| ***E02F 3/38*** | (2006.01) |
| ***E02F 3/42*** | (2006.01) |
| ***E02F 3/43*** | (2006.01) |
| ***E02F 9/22*** | (2006.01) |

(52) U.S. Cl.

CPC ..... *E02F 3/38* (2013.01); *E02F 3/422* (2013.01); *E02F 3/433* (2013.01); *E02F 9/2271* (2013.01)

(58) Field of Classification Search

CPC ..... E02F 3/286; E02F 3/306; E02F 3/3402; E02F 3/38; E02F 3/402; E02F 3/422; E02F 3/433; E02F 9/2271; B66F 9/0655; A01D 87/0076

See application file for complete search history.

(56) References Cited

U.S. PATENT DOCUMENTS

| | | | | |
|---|---|---|---|---|
| 2,710,699 A | | 6/1955 | Dorkins | |
| 2,890,683 A | | 6/1959 | Pilch | |
| 2,990,072 A | | 6/1961 | Mindrum | |
| 3,178,046 A | | 4/1965 | Lull | |
| 3,184,085 A | * | 5/1965 | Randall | E02F 3/32 414/694 |
| 3,382,995 A | | 5/1968 | Strader | |
| 4,162,873 A | | 7/1979 | Smith, Jr. | |
| 4,306,832 A | | 12/1981 | Schmiesing | |
| 4,403,427 A | | 9/1983 | Dahlquist | |
| 4,431,364 A | * | 2/1984 | Redenbarger | E02F 3/433 414/697 |

(Continued)

FOREIGN PATENT DOCUMENTS

| | | |
|---|---|---|
| EP | 0744500 A2 | 11/1996 |
| EP | 1775389 A1 | 4/2007 |

(Continued)

OTHER PUBLICATIONS

International Search Report and Written Opinion dated Jan. 3, 2020 for International Application No. PCT/US2019/049148 filed Aug. 30, 2019, 15 pages.

*Primary Examiner* — Ronald P Jarrett

(74) *Attorney, Agent, or Firm* — John Veldhuis-Kroeze; Westman, Champlin & Koehler, P.A.

(57) ABSTRACT

Disclosed embodiments include power machines, such as front-end loaders and utility vehicles, with a lift arm and a bucket leveling system utilizing four-bar linkages which mechanically level an attached implement as the lift arm is raised and lowered.

25 Claims, 6 Drawing Sheets

(56) References Cited

U.S. PATENT DOCUMENTS

| | | | | |
|---|---|---|---|---|
| 4,553,899 | A | 11/1985 | Magni | |
| 4,741,662 | A | 5/1988 | Schmiesing | |
| 4,999,022 | A | 3/1991 | Veys | |
| 5,016,767 | A * | 5/1991 | Thibault | B66F 11/044 182/2.9 |
| 5,533,856 | A | 7/1996 | Friesen et al. | |
| 5,596,823 | A * | 1/1997 | Clasen | E01H 5/06 37/232 |
| 5,688,101 | A | 11/1997 | Kim | |
| 5,984,618 | A | 11/1999 | Deneve et al. | |
| 6,726,437 | B2 | 4/2004 | Albright et al. | |
| 6,860,396 | B2 * | 3/2005 | Seppala | E02F 3/306 212/231 |
| 6,860,707 | B2 | 3/2005 | Roan et al. | |
| 8,103,418 | B2 | 1/2012 | Osswald et al. | |
| 8,602,153 | B2 | 12/2013 | Osswald et al. | |
| 9,308,939 | B2 | 4/2016 | Osswald et al. | |
| 2007/0031233 | A1 * | 2/2007 | Frey | E02F 3/422 414/685 |
| 2012/0189418 | A1 | 7/2012 | Husson et al. | |

FOREIGN PATENT DOCUMENTS

| | | | |
|---|---|---|---|
| FR | 1241189 | A | 9/1960 |
| GB | 2353270 | A | 2/2001 |

* cited by examiner

LIFT ARM LEVELING SYSTEM

CROSS-REFERENCE TO RELATED APPLICATION

This application claims the benefit of U.S. Provisional Application No. 62/725,786, which was filed on Aug. 31, 2018.

BACKGROUND

This disclosure is directed toward power machines. More particularly, this disclosure is directed toward bucket or implement leveling systems for lift arms of power machines such as front-end loaders.

Power machines, for the purposes of this disclosure, include any type of machine that generates power for accomplishing a particular task or a variety of tasks. One type of power machine is a work vehicle. Work vehicles are generally self-propelled vehicles that have a work device, such as a lift arm (although some work vehicles can have other work devices) that can be manipulated to perform a work function. Work vehicles include loaders, excavators, utility vehicles, tractors, and trenchers, to name a few examples.

Different types of power machines, such as loaders and utility vehicles, include a lift arm structure having an implement carrier pivotally coupled at a distal end of the arm. Often, a bucket or other implement is coupled to the lift arm by mounting the bucket to the implement carrier. As the lift arm is raised and lowered, it can be advantageous to maintain the bucket at a substantially constant orientation relative to the ground, which can require a changing orientation of the bucket relative to the lift arm. Mechanical bucket leveling systems exist for maintaining a substantially constant bucket orientation relative to the ground. Some of these systems require a significant number of additional linkages or components or have disadvantages or limitations in their operation.

The discussion above is merely provided for general background information and is not intended to be used as an aid in determining the scope of the claimed subject matter.

SUMMARY

Disclosed embodiments include power machines, such as front-end loaders and utility vehicles, with a telescoping lift arm assembly and a bucket leveling system. The bucket leveling systems utilize geometries that allow optimized or improved bucket leveling performance with two four-bar linkages. For example, disclosed embodiments allow the bucket leveling to be mechanically implemented without the use of additional linkages required in some systems.

In exemplary embodiments, a first or constant length leveling link is pivotally coupled to the lift arm and to a tilt cylinder. A leveling cylinder, or a variable length leveling link, is pivotally coupled to a frame and to the first leveling link. Two four-bar linkages providing the bucket leveling are formed using the frame, the lift arm, the leveling link, the leveling cylinder or variable length leveling link, the implement carrier, and the tilt cylinder.

In some exemplary embodiments, a first four-bar linkage includes two variable length links. A first of the variable length links is provided by a leveling cylinder. A second of the variable length links is provided by a telescoping lift arm. In some exemplary embodiments, a pivot on a frame for a leveling cylinder is positioned above and rearward of a pivot on the frame for the lift arm. In some exemplary embodiments, a pivot on the leveling link is positioned rearward of a line of action formed between pivots on the leveling link for a tilt cylinder and for an implement carrier.

Disclosed embodiments include power machines, and lift arm assemblies for power machines, having improved mechanical self-leveling features. One general aspect includes a lift arm assembly (350-2; 450) of a power machine (100; 200; 300; 400) having an attachment structure for securing an implement (436) thereto, the lift arm assembly including: a lift arm including a main lift arm portion (316-2; 416) pivotally attached to a frame (110; 310; 410) of the power machine at a first pivot attachment (312; 412) and a telescoping portion (318; 418) that is extendable and retractable relative to the main lift arm portion; a variable length link (328-2; 428) pivotally attached to the frame (110; 310; 410) at a second pivot attachment (326; 426); and a fixed length link (322; 422) pivotally attached to the telescoping portion of the main lift arm portion at a third pivot attachment (314; 414) and pivotally attached to the variable length link (328-1; 328-2; 428) at a fourth pivot attachment (320; 420); where the lift arm, frame, variable length link and fixed length link form a lift arm four-bar linkage with two variable length links.

Implementations may include one or more of the following features. The lift arm assembly and further including: a tilt cylinder (235; 340; 440) pivotally attached to the fixed length leveling link (322; 422) at a fifth pivot attachment (338; 438); and implement connection points for mounting one of the implement (436) and an implement carrier (334; 434) to the lift arm assembly, including a sixth pivot attachment (330; 430) on the lift arm and a seventh pivot attachment (332; 432) on the tilt cylinder (235; 340; 440); where the fixed length link (322; 422), the tilt cylinder (235; 340; 440), the one of the implement (436) and the implement carrier, and the lift arm form a tilt control four-bar linkage (352-1; 352-2), and where the lift arm four-bar linkage and the tilt control four-bar linkage provide mechanical self-leveling of the implement (436) coupled to the lift arm assembly as the lift arm assembly is pivotally raised and lowered relative to the frame. The lift arm assembly where the lift arm assembly is configured such that when the main lift arm portion (316-2; 416) is in a fully lowered position and the telescoping portion (318; 418) is retracted within the main lift arm portion, a first line of action (462) between the first pivot attachment (312; 412) and the third pivot attachment (314; 414) is approximately parallel to a second line of action (460) between the second pivot attachment (326; 426) and the fourth pivot attachment (320; 420).

The lift arm assembly where the telescoping portion (318; 418) of the main lift arm is configured to extend and retract relative to a main lift arm portion (316-2; 416) under power of a telescoping actuator (319). The lift arm assembly where the one of the implement and the implement carrier is pivotally attached to the telescoping portion (318; 418) of the lift arm at the sixth pivot attachment (330; 430). The lift arm assembly where the variable length link (328-2; 428) is hydraulically coupled to the telescoping actuator (319) such that the variable length link extends and retracts as the telescoping portion (318; 418) of the lift arm extends and retracts. The lift arm assembly where the variable length link (328-2; 428) is a cylinder.

The lift arm assembly where the second pivot attachment (326; 426), between the variable length link (328-2; 428) and the frame (110; 310; 410) is positioned above and rearward of the first pivot attachment (312; 412) between the lift arm and the frame. The lift arm assembly where the second pivot attachment (326; 426), between the variable length link (328-2; 428) and the frame (110; 310; 410), and the first pivot attachment (312; 412) between the lift arm and the frame, are arranged such that a line of action (324) extending between the first and second pivot attachments forms an angle relative to a horizontal direction of at least approximately 105 degrees.

The lift arm assembly where the lift arm assembly is configured such that the fourth pivot attachment (320; 420) is positioned rearward of a line of action (480) extending between the third pivot attachment (314; 414) and the fifth pivot attachment (338; 438). The lift arm assembly and further including a port relief valve (502) configured to couple the tilt cylinder (235; 340; 440) to a tank (504) to limit a stroke of the tilt cylinder when one of the tilt cylinder, the implement (436) and an implement carrier encounters interference with the lift arm.

One general aspect includes a power machine (100; 200; 300; 400) configured to provide mechanical self-leveling of an implement (436), the power machine including: a frame (110; 310; 410); a power source (222) mounted to the frame; a power conversion system (224) operably coupled to the power source; a lift arm (316-1; 316-2; 416) pivotally attached to the frame at a first pivot attachment (312; 412); a lift actuator (238; 415) in communication with the power conversion system and coupled between the frame and the lift arm and the lift actuator selectively operable to raise and lower the lift arm relative to the frame; a first leveling link (328-1; 328-2; 428) pivotally attached to the frame (110; 310; 410) at a second pivot attachment (326; 426); a second leveling link (322; 422) pivotally attached to the lift arm at a third pivot attachment (314; 414) and pivotally attached to the first leveling link (328-1; 328-2; 428) at a fourth pivot attachment (320; 420); a tilt actuator (235; 340; 440) in communication with the power conversion system and pivotally attached at a fifth pivot attachment (338; 438) to the second leveling link (322; 422); and an implement attachment mechanism or implement carrier (334; 434) configured to mount the implement (436) to the lift arm, so that a combination of the implement and the implement attachment mechanism is pivotally attached to the lift arm (316-1; 316-2; 416) at a sixth pivot attachment (330; 430) and pivotally attached to the tilt actuator (235; 340; 440) at a seventh pivot attachment (332; 432); where the frame (110; 310; 410), the lift arm (316-1; 316-2; 416), the second leveling link (322; 422) and the first leveling link (328-1; 328-2; 428) form a first four-bar linkage (354-1; 354-2), where the second leveling link (322; 422), the tilt actuator (235; 340; 440), the implement attachment mechanism and the lift arm (316-1; 316-2; 416) form a second four-bar linkage (352-1; 352-2), and where the first and second four-bar linkages provide mechanical self-leveling of the implement (436) mounted to the lift arm as the lift arm is pivotally raised and lowered relative to the frame.

Implementations may include one or more of the following features. The power machine where one of the first and second four-bar linkages includes two bars with variable lengths. The power machine where the lift arm (316-2; 416) is a telescoping lift arm having a telescoping portion (318; 418) that selectively extends and retracts relative to a main lift arm portion (316-2; 416) under power of a telescoping actuator (319). The power machine where the implement attachment mechanism is pivotally attached to the telescoping portion (318; 418) of the lift arm (316-2; 416)) at the sixth pivot attachment (330; 430). The power machine where the second leveling link (322; 422) is pivotally attached to the telescoping portion (318; 418) of the lift arm (316-2; 416) at the third pivot attachment (314; 414). The power machine where the first leveling link (328-2; 428) is a variable length leveling link. The power machine where the first leveling link (328-2; 428) is operably coupled to the telescoping actuator (319) such that the first leveling link extends and retracts as the telescoping portion (318; 418) of the lift arm (316-2; 416) extends and retracts. The power machine where the first leveling link (328-2; 428) is a cylinder. The power machine where the lift arm assembly is configured such that when the lift arm (316-2; 416) is in a fully lowered position and the telescoping portion (318; 418) is retracted within the lift arm, a first line of action (462) between the first pivot attachment, (312; 412) and the third pivot attachment (314; 414) is approximately parallel to a second line of action (460) between the second pivot attachment (326; 426) and the fourth pivot attachment (320; 420). The power machine where the second pivot attachment (326; 426) and the first pivot attachment (312; 412) are arranged such that a line of action (324) extending between the first and second pivot attachments forms an angle relative to a horizontal direction of at least approximately 100 degrees. The power machine where the second pivot attachment (326; 426) is positioned above and rearward of the first pivot attachment (312; 412). The power machine where the second pivot attachment (326; 426) and the first pivot attachment (312; 412) are arranged such that a line of action (324) extending between the first and second pivot attachments forms an angle relative to a horizontal direction of between about 100 degrees and 110 degrees. The power machine where the lift arm assembly is configured such that the fourth pivot attachment (320; 420) is positioned rearward of a line of action (480) extending between the third pivot attachment (314; 414) and the fifth pivot attachment (338; 438). The power machine where the tilt actuator is a tilt cylinder, and further including a port relief valve (502) configured to couple the tilt cylinder (235; 340; 440) to a tank (504) in order to limit a stroke of the tilt cylinder when one of the tilt cylinder and the implement (436) encounters interference with the lift arm.

This Summary and the Abstract are provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

FIG. 3-1 is a diagrammatic illustration of a lift arm assembly having a bucket leveling system utilizing two four-bar linkages.

FIG. 3-2 is a diagrammatic illustration of a lift arm assembly having a bucket leveling system utilizing two four-bar linkages with a telescoping lift arm.

FIG. 6-1 is a diagrammatic side view illustration of a lift arm assembly and bucket leveling system showing a tilt cylinder with an advantageously long stroke length and a port relief valve that prevents overstroking of the tilt cylinder when the lift arm is in a raised position.

FIG. 6-2 is a diagrammatic side view illustration of a lift arm assembly and bucket leveling system and limitations of a tilt cylinder without the added length shown in FIG. 6-1.

DETAILED DESCRIPTION

The concepts disclosed in this discussion are described and illustrated with reference to exemplary embodiments. These concepts, however, are not limited in their application to the details of construction and the arrangement of components in the illustrative embodiments and are capable of being practiced or being carried out in various other ways. The terminology in this document is used for description and should not be regarded as limiting. Words such as "including," "comprising," and "having" and variations thereof as used herein are meant to encompass the items listed thereafter, equivalents thereof, as well as additional items.

Disclosed embodiments include power machines, such as front-end loaders and utility vehicles, with a lift arm and a bucket leveling system. The bucket leveling system utilizes geometries that allow optimized or improved bucket leveling performance with two four-bar linkages, as compared to conventional bucket leveling systems which utilized additional components. For example, disclosed embodiments allow the bucket leveling to be mechanically implemented without the use of additional linkages required in some systems to facilitate a third four-bar linkage. In exemplary embodiments, a first or constant length leveling link is pivotally coupled to the lift arm and to a tilt cylinder. A leveling cylinder, or a variable length leveling link, is pivotally coupled to a frame and to the first leveling link. Two four-bar linkages providing the bucket leveling are formed using the frame, the lift arm, the leveling link, the leveling cylinder or variable length leveling link, the implement carrier, and the tilt cylinder.

These concepts can be practiced on various power machines, as will be described below. A representative power machine on which the embodiments can be practiced is illustrated in diagram form in FIG. 1. For the sake of brevity, only one power machine is illustrated and discussed as being a representative power machine. However, as mentioned above, the embodiments below can be practiced on any of a number of power machines, including power machines of different types from those specifically illustrated. Power machines, for the purposes of this discussion, include a frame, at least one work element, and a power source that can provide power to the work element to accomplish a work task. One type of power machine is a self-propelled work vehicle. Self-propelled work vehicles are a class of power machines that include a frame, work element, and a power source that can provide power to the work element. At least one of the work elements is a motive system for moving the power machine under power.

Figure 1:
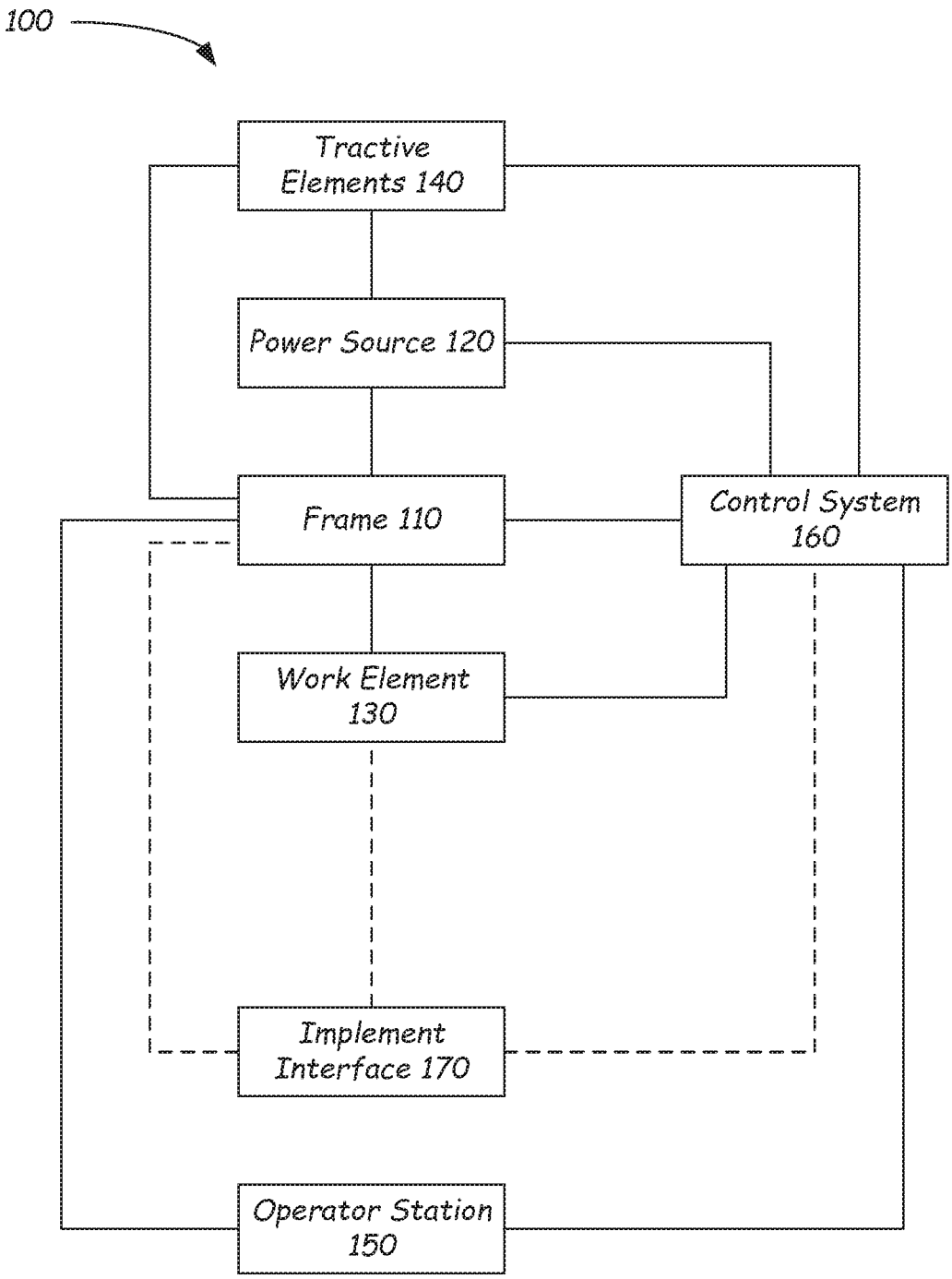
FIG. 1 is a block diagram illustrating functional systems of a representative power machine on which embodiments of the present disclosure can be advantageously practiced.

FIG. 1 is a block diagram that illustrates the basic systems of a power machine 100, which can be any of a number of different types of power machines, upon which the embodiments discussed below can be advantageously incorporated. The block diagram of FIG. 1 identifies various systems on power machine 100 and the relationship between various components and systems. As mentioned above, at the most basic level, power machines for the purposes of this discussion include a frame, a power source, and a work element. The power machine 100 has a frame 110, a power source 120, and a work element 130. Because power machine 100 shown in FIG. 1 is a self-propelled work vehicle, it also has tractive elements 140, which are themselves work elements provided to move the power machine over a support surface and an operator station 150 that provides an operating position for controlling the work elements of the power machine. A control system 160 is provided to interact with the other systems to perform various work tasks at least in part in response to control signals provided by an operator.

Certain work vehicles have work elements that can perform a dedicated task. For example, some work vehicles have a lift arm to which an implement such as a bucket is attached such as by a pinning arrangement. The work element, i.e., the lift arm can be manipulated to position the implement for performing the task. The implement, in some instances can be positioned relative to the work element, such as by rotating a bucket relative to a lift arm, to further position the implement. Under normal operation of such a work vehicle, the bucket is intended to be attached and under use. Such work vehicles may be able to accept other implements by disassembling the implement/work element combination and reassembling another implement in place of the original bucket. Other work vehicles, however, are intended to be used with a wide variety of implements and have an implement interface such as implement interface 170 shown in FIG. 1. At its most basic, implement interface 170 is a connection mechanism between the frame 110 or a work element 130 and an implement, which can be as simple as a connection point for attaching an implement directly to the frame 110 or a work element 130 or more complex, as discussed below.

On some power machines, implement interface 170 can include an implement carrier, which is a physical structure movably attached to a work element. The implement carrier has engagement features and locking features to accept and secure any of a number of implements to the work element. One characteristic of such an implement carrier is that once an implement is attached to it, it is fixed to the implement (i.e. not movable with respect to the implement) and when the implement carrier is moved with respect to the work element, the implement moves with the implement carrier. The term implement carrier as used herein is not merely a pivotal connection point, but rather a dedicated device specifically intended to accept and be secured to various different implements. The implement carrier itself is mountable to a work element 130 such as a lift arm or the frame 110. Implement interface 170 can also include one or more power sources for providing power to one or more work elements on an implement. Some power machines can have a plurality of work element with implement interfaces, each of which may, but need not, have an implement carrier for receiving implements. Some other power machines can have a work element with a plurality of implement interfaces so that a single work element can accept a plurality of implements simultaneously. Each of these implement interfaces can, but need not, have an implement carrier.

Some power machines can have implements or implement like devices attached to it such as by being pinned to a lift arm with a tilt actuator also coupled directly to the implement or implement type structure. A common example of such an implement that is rotatably pinned to a lift arm is a bucket, with one or more tilt cylinders being attached to a bracket that is fixed directly onto the bucket such as by welding or with fasteners. Such a power machine does not have an implement carrier, but rather has a direct connection between a lift arm and an implement.

Frame 110 includes a physical structure that can support various other components that are attached thereto or positioned thereon. The frame 110 can include any number of individual components. Some power machines have frames that are rigid. That is, no part of the frame is movable with respect to another part of the frame. Other power machines have at least one portion that can move with respect to another portion of the frame. For example, excavators can have an upper frame portion that rotates with respect to a lower frame portion. Other work vehicles have articulated frames such that one portion of the frame pivots with respect to another portion for accomplishing steering functions.

Frame 110 supports the power source 120, which is configured to provide power to one or more work elements 130 including the one or more tractive elements 140, as well as, in some instances, providing power for use by an attached implement via implement interface 170. Power from the power source 120 can be provided directly to any of the work elements 130, tractive elements 140, and implement interfaces 170. Alternatively, power from the power source 120 can be provided to a control system 160, which in turn selectively provides power to the elements that capable of using it to perform a work function. Power sources for power machines typically include an engine such as an internal combustion engine and a power conversion system such as a mechanical transmission or a hydraulic system that is configured to convert the output from an engine into a form of power that is usable by a work element. Other types of power sources can be incorporated into power machines, including electrical sources or a combination of power sources, known generally as hybrid power sources.

FIG. 1 shows a single work element designated as work element 130, but various power machines can have any number of work elements. Work elements are typically attached to the frame of the power machine and movable with respect to the frame when performing a work task. In addition, tractive elements 140 are a special case of work element in that their work function is generally to move the power machine 100 over a support surface. Tractive elements 140 are shown separate from the work element 130 because many power machines have additional work elements besides tractive elements, although that is not always the case. Power machines can have any number of tractive elements, some or all of which can receive power from the power source 120 to propel the power machine 100. Tractive elements can be, for example, track assemblies, wheels attached to an axle, and the like. Tractive elements can be mounted to the frame such that movement of the tractive element is limited to rotation about an axle (so that steering is accomplished by a skidding action) or, alternatively, pivotally mounted to the frame to accomplish steering by pivoting the tractive element with respect to the frame.

Power machine 100 includes an operator station 150 that includes an operating position from which an operator can control operation of the power machine. In some power machines, the operator station 150 is defined by an enclosed or partially enclosed cab. Some power machines on which the disclosed embodiments may be practiced may not have a cab or an operator compartment of the type described above. For example, a walk behind loader may not have a cab or an operator compartment, but rather an operating position that serves as an operator station from which the power machine is properly operated. More broadly, power machines other than work vehicles may have operator stations that are not necessarily similar to the operating positions and operator compartments referenced above. Further, some power machines such as power machine 100 and others, whether or not they have operator compartments or operator positions, may be capable of being operated remotely (i.e. from a remotely located operator station) instead of or in addition to an operator station adjacent or on the power machine. This can include applications where at least some of the operator-controlled functions of the power machine can be operated from an operating position associated with an implement that is coupled to the power machine. Alternatively, with some power machines, a remote-control device can be provided (i.e. remote from both of the power machine and any implement to which is it coupled) that can control at least some of the operator-controlled functions on the power machine.

Figure 2:
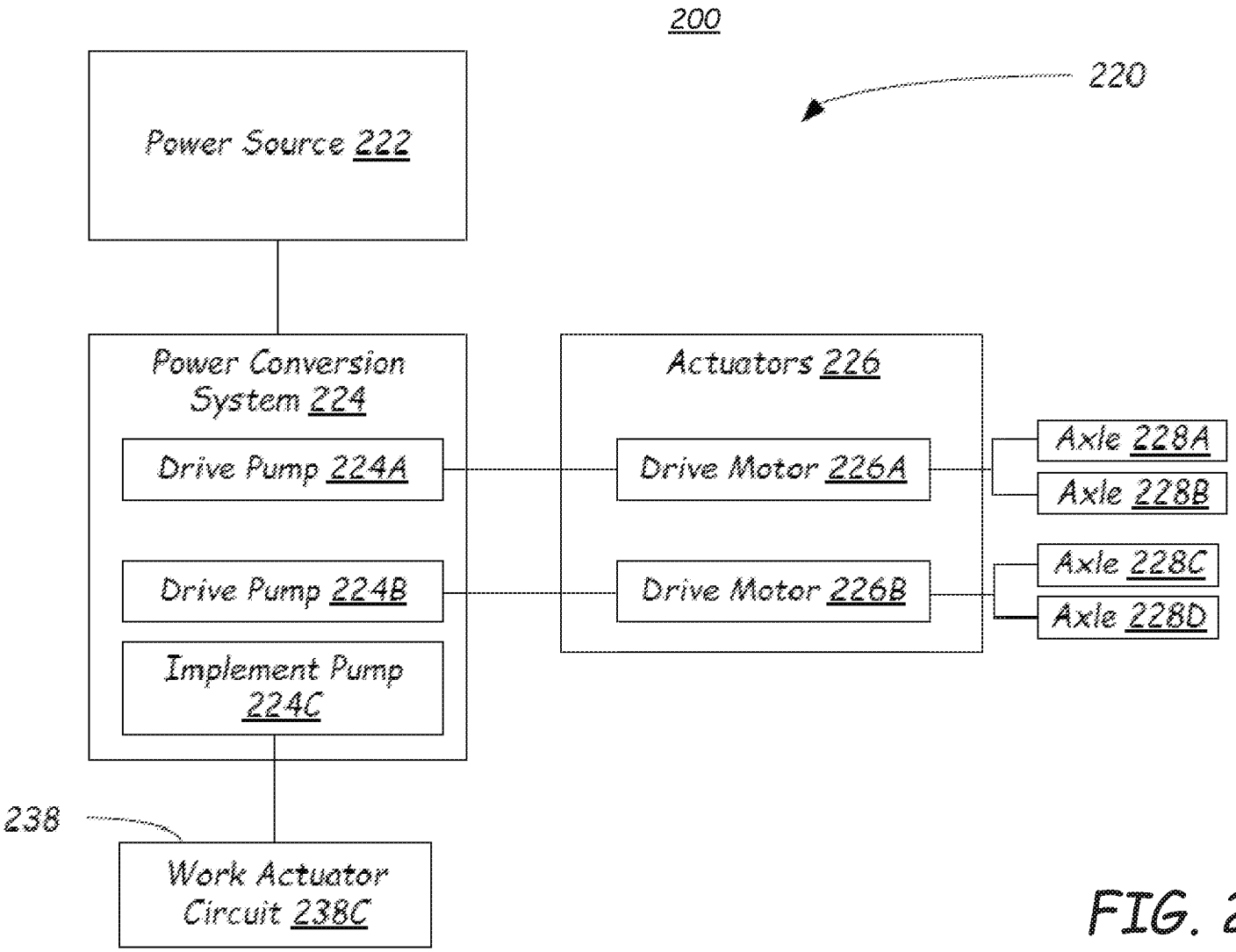
FIG. 2 is a block diagram illustrating components of a power system of a loader such as the loader illustrated in FIG. 1.

FIG. 2 includes, among other things, a diagram of various components of a power system 220 of a power machine 200, which can be such as power machine 100 illustrated in FIG. 1. Power system 220 includes one or more power sources 222 that can generate and/or store power for use on various machine functions. On power machine 200, the power system 220 includes an internal combustion engine. Other power machines can include electric generators, rechargeable batteries, various other power sources or any combination of power sources that can provide power for given power machine components. The power system 220 also includes a power conversion system 224, which is operably coupled to the power source 222. Power conversion system 224 is, in turn, coupled to one or more actuators 226, which can perform a function on the power machine. Power conversion systems in various power machines can include various components, including mechanical transmissions, hydraulic systems, and the like. The power conversion system 224 of power machine 200 includes a pair of hydrostatic drive pumps 224A and 224B, which are selectively controllable to provide a power signal to drive motors 226A and 226B. The drive motors 226A and 226B in turn are each operably coupled to axles, with drive motor 226A being coupled to axles 228A and 228B and drive motor 226B being coupled to axles 228C and 228D. The axles 228A-D are in turn coupled to tractive elements 219A-D, respectively. The drive pumps 224A and 224B can be mechanically, hydraulic, and/or electrically coupled to operator input devices to receive actuation signals for controlling the drive pumps.

The arrangement of drive pumps, motors, and axles in power machine 200 is but one example of an arrangement of these components. As discussed above, power machine 200 can be a utility vehicle or can be a front-end loader, such as a skid-steer loader, a track loader, or an articulated loader, and thus includes tractive elements on each side of the power machine. For example, in skid-steer loaders, the tractive elements are controlled together via the output of a single hydraulic pump, either through a single drive motor or with individual drive motors. Various other configurations and combinations of hydraulic drive pumps and motors can be employed as may be advantageous. Further, disclosed embodiments can be used on other types of power machines.

The power conversion system 224 of the power machine also includes a hydraulic implement pump 224C, which is also operably coupled to the power source 222. The hydraulic implement pump 224C is operably coupled to work actuator circuit 238C. Work actuator circuit 238 includes lift cylinders 238 and tilt cylinders 235 as well as control logic (such as one or more valves) to control actuation thereof.

The control logic selectively allows, in response to operator inputs, for actuation of the lift cylinders and/or tilt cylinders. In some machines, the work actuator circuit also includes control logic to selectively provide a pressurized hydraulic fluid to an attached implement.

The description of power machine 100 above is provided for illustrative purposes, to provide illustrative environments on which the embodiments discussed below can be practiced. While the embodiments discussed can be practiced on a power machine such as is generally described by the power machine 100 shown in the block diagram of FIG. 1, unless otherwise noted or recited, the concepts discussed below are not intended to be limited in their application to the environments specifically described above.

Figures 1, 3:
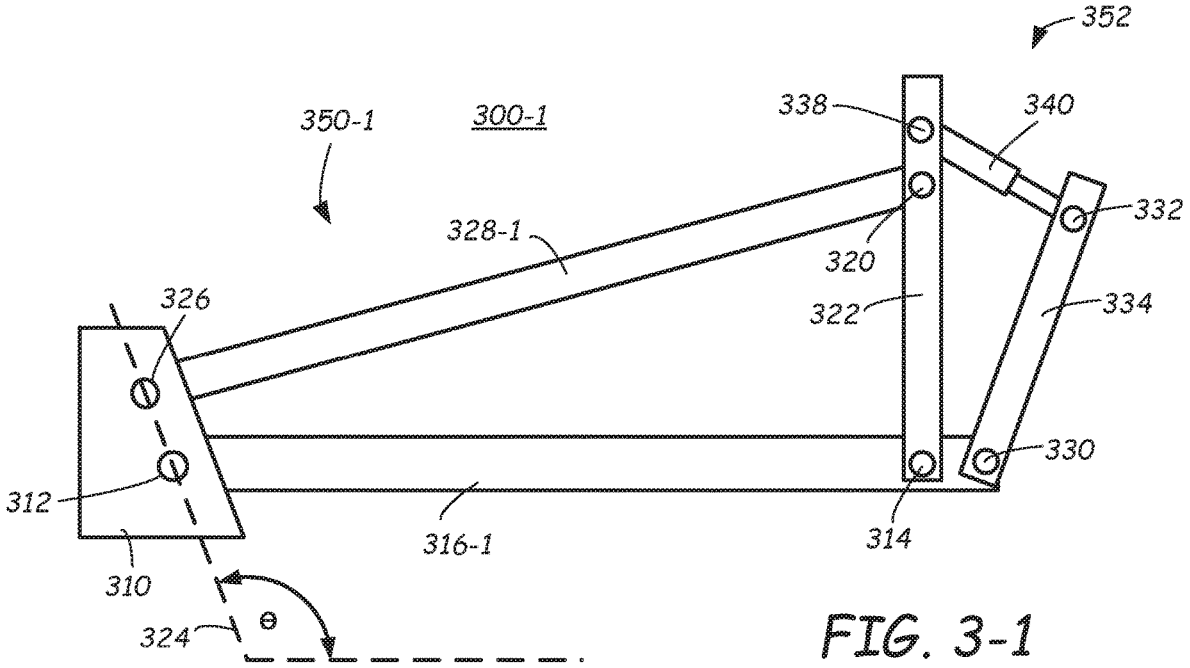
Figures 2, 3:
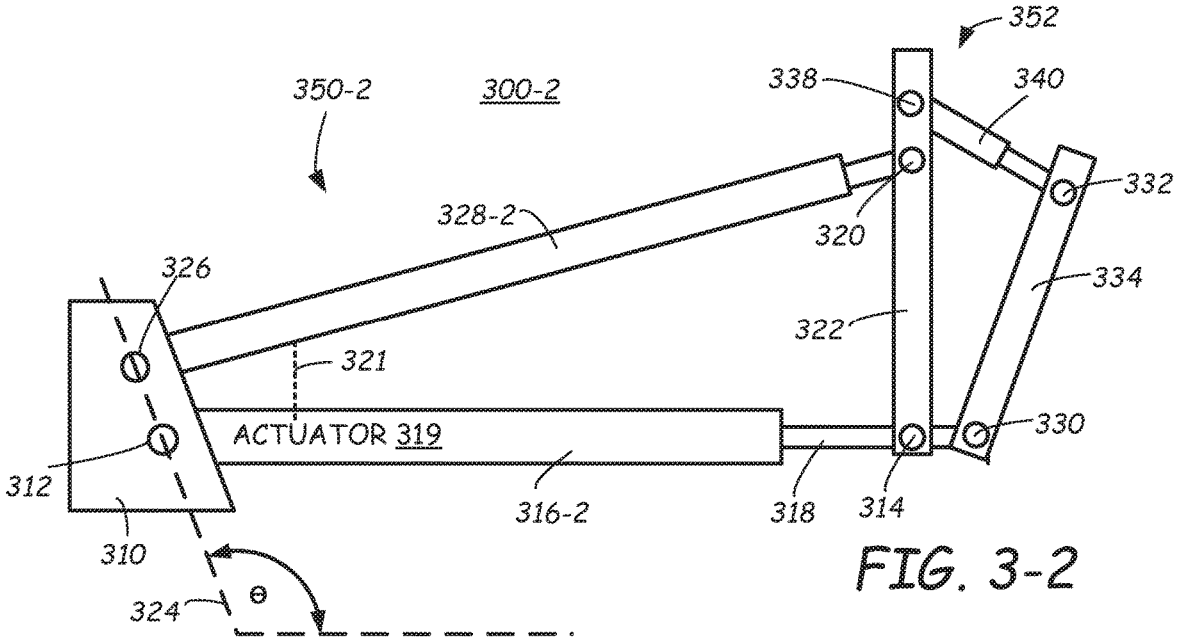

Referring now to FIGS. 3-1 and 3-2, shown are diagrammatic illustrations of lift arm assemblies 350-1 and 350-2 of power machines 300-1 and 300-2 having components for providing mechanical self-leveling of a bucket or other implement attached to an implement carrier 334. Each of lift arm assemblies includes two four-bar linkages which together provide improved self-leveling operations for the bucket or implement attached to implement carrier 334. The lift arm assembly shown in FIG. 3-1 includes a lift arm 316-1 that forms portions of the four-bar linkages. The lift arm assembly shown in FIG. 3-2 differs from the lift arm assembly shown in FIG. 3-1 only in that the lift arm 316-2 is a telescoping style lift arm having a telescoping portion 318 that telescopes, under power of a telescoping cylinder or actuator 319, from the main portion 316-2. It must be noted that the lift arm assemblies shown in FIGS. 3-1 and 3-2 are diagrammatically provided to illustrate certain features such as the two four-bar linkages in each lift arm assembly used to provide the mechanical self-leveling aspects of disclosed embodiments. It must be understood that the particular geometries illustrated in FIGS. 3-1 and 3-2 are not intended to reflect specific pivot point locations, orientations of components, scale of components, or other features unless otherwise stated. Further illustration of lift arm assembly features is also provided in FIGS. 4-6.

In each of the lift arm assemblies, the lift arm 316-1 or 316-2 is pivotally attached to a frame 310 at a pivot attachment or coupling 312. A solid leveling link 328-1 is pivotally attached to the frame 310 and pivot attachment or coupling 326 in lift arm assembly 350-1. Lift arm assembly 350-2 has a variable length level link 328-2, in the form of a leveling cylinder, that is pivotally attached to frame 310 at a pivot attachment or coupling 326. In exemplary embodiments, it has been found that improved leveling performance over a range of lift arm positions is achieved with pivot attachment 326 of leveling link 328-1 or leveling cylinder 328-2 positioned above and behind (toward an operator compartment of the power machine) pivot attachment 312 of lift arm 316. In a particular exemplary embodiment, it has been found that pivot attachment 326 of leveling link 328-1 or leveling cylinder 328-2 can advantageously be positioned above and rearward of pivot attachment 312 of the lift arm such that a line of action 324 extending between pivot attachments 312 and 326 forms an angle θ, relative to a horizontal direction, of at least approximately 105°. However, this geometrical relationship is not required in all embodiments.

A leveling link 322 is also provided in each of the lift arm assemblies to facilitate the mechanical self-leveling functions. Leveling link 322, which is a fixed length link, includes three pivot attachments. First, leveling link 322 is pivotally attached to lift arm 316 at pivot attachment 314. This pivot attachment 314 can be to a main lift arm portion in lift arm 316-1, or to the telescoping lift arm portion 318 in lift arm 316-2. A second pivot attachment on each leveling link 322 is a pivot attachment 320 between leveling link 328-1 or leveling cylinder 328-2 and the leveling link 322. The third pivot attachment on each leveling link 322 is a pivot attachment 338 between tilt cylinder 340 and the leveling link 322.

Also shown in FIGS. 3-1 and 3-2 is an implement carrier or interface 334 configured to allow a bucket or other implement to be mounted on the lift arm 316. Implement carrier 334 is pivotally attached at a pivot attachment 330 to the lift arm. In the embodiment shown in FIG. 3-1, pivot attachment 330 between implement carrier 334 and the lift arm 316-1 occurs in the main lift arm portion, while in FIG. 3-2 pivot attachment 330 to lift arm 316-2 occurs on telescoping portion 318. Implement carrier 334 is also pivotally attached, at a pivot attachment 332, to tilt cylinder 340.

Leveling cylinder 328-2 can be, in the embodiment shown in FIG. 3-2, hydraulically coupled to the telescoping cylinder or actuator 319 that controls extension and retraction of telescoping portion 318 of lift arm 316-2. The hydraulic coupling is diagrammatically illustrated as hydraulic connection 321 but can include various valves or other hydraulic components. As the lift arm telescoping actuator extends/retracts to extend/retract telescoping portion 318, leveling cylinder 328-2 also extends/retracts. This helps to maintain the positioning of leveling link 322 relative to the telescoping portion 318 of lift arm 316-2.

As noted above, each of the lift arm assemblies shown in FIGS. 3-1 and 3-2 provide self-leveling using two four-bar linkages, instead of using three four-bar linkages as is common in the prior art. In the lift arm assembly shown in FIG. 3-1, the two four-bar linkages are designated as 354-1 and 352-1. In the lift arm assembly shown in FIG. 3-2, the two four-bar linkages are designated as 354-2 and 352-2. The first four-bar linkage 354-1 or 354-2 includes frame 310, lift arm 316-1 or 316-2 (including telescoping portion 318), leveling link 322 and leveling cylinder (or other adjustable length leveling link) 328-2 or solid leveling link 328-1. The attachments for the first four-bar linkage include pivot attachment 312 between the lift arm and frame 310, pivot attachment 314 between the lift arm and leveling link 322, pivot attachment 320 between leveling link 328-1 or leveling cylinder 328-2 and leveling link 322, and pivot attachment 326 between leveling link 328-1 leveling cylinder 328-2 and frame 310.

The second four-bar linkage includes leveling link 322, tilt cylinder 340, lift arm 316 and a portion of implement carrier 334. The pivot attachments for the second four-bar linkage include pivot attachment 314 between lift arm 316 and leveling link 322, pivot attachment 330 between lift arm 316 and implement carrier 334, pivot attachment 332 between tilt cylinder 340 and implement carrier 334, and pivot attachment 338 between tilt cylinder 340 and leveling link 322. A notable feature of the lift arm assemblies discussed with reference to FIGS. 3-1 and 3-2, as well as in FIGS. 4-6 discussed below, is that the tilt cylinder is pivotally coupled directly between leveling link 422 and implement carrier 434, instead of through additional linkages. In some embodiments, as discussed above, a particular power machine may not have an implement carrier and instead may have an implement such as a bucket pinned directly to a lift arm and a leveling link. For the purposes of clarity, the structure on either of an implement carrier or an implement that forms a portion of the second four bar linkage is referred to an implement portion.

Figure 4:
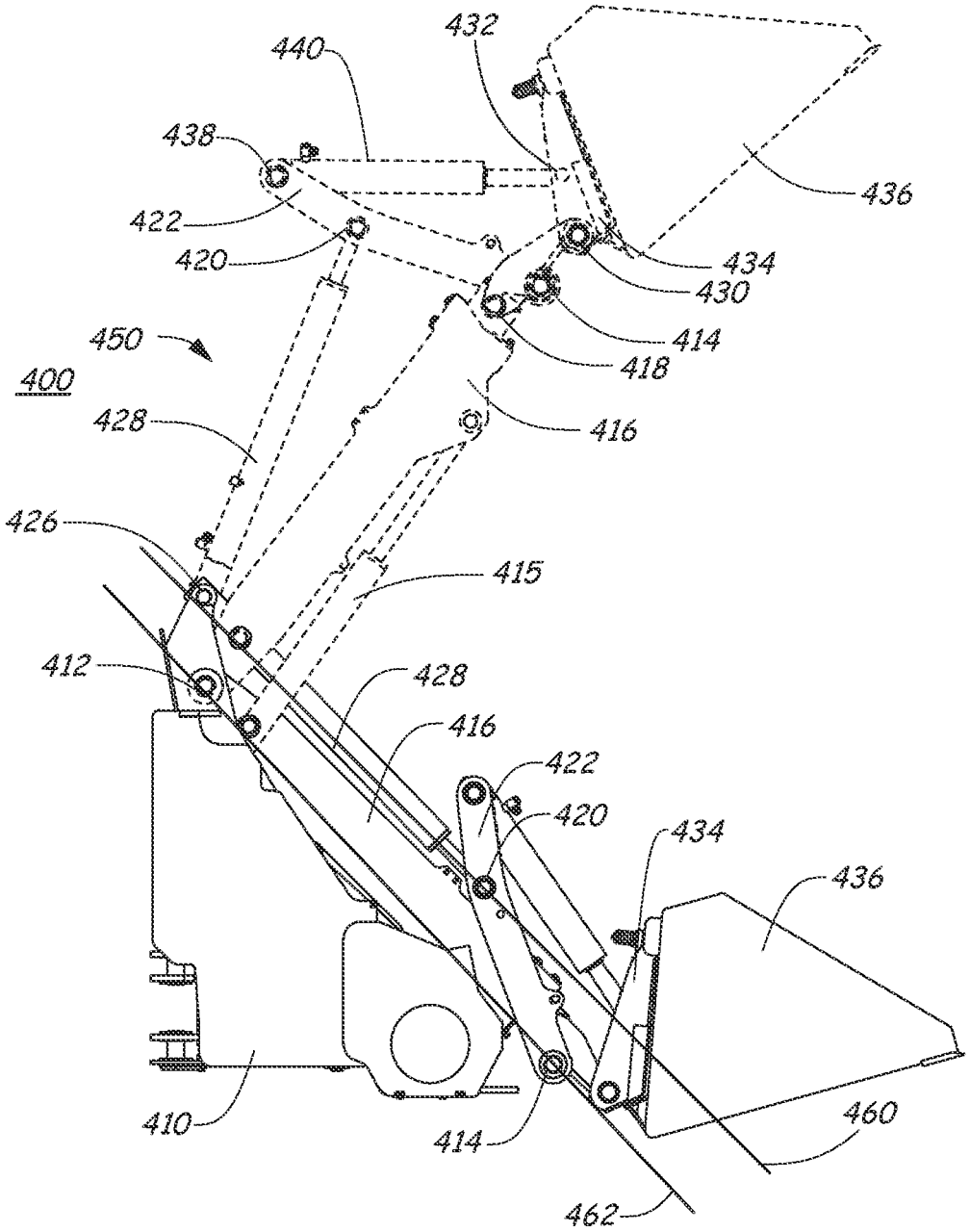
FIG. 4 is a diagrammatic side view illustration of a lift arm assembly and bucket leveling system showing the lift arm assembly showing lift arm assembly in lowered and raised positions.

Referring now to FIG. 4, shown is a diagrammatic illustration of a lift arm assembly 450 of a power machines 400 having components similar to those discussed above with reference to FIG. 3-2 for providing mechanical self-leveling of a bucket 436 or another implement. Lift arm assembly 450 includes the above-discussed two four-bar linkages which together provide improved self-leveling operations. In FIG. 4, the lift arm assembly 450 is shown both in a fully lowered position, and in a raised position, to illustrate features such as movement of the leveling link 422 relative to the lift arm 416.

In lift arm assembly 450, lift arm 416 is pivotally attached to a frame 410 at a pivot attachment or coupling 412. A variable length leveling link 428, again in the form of a leveling cylinder, is also pivotally attached to frame 410 at a pivot attachment or coupling 426. As discussed above, pivot attachment 426 of leveling cylinder 428 is positioned above and behind pivot attachment 412 of lift arm 416, for example again with the line of action extending between pivot attachments 412 and 426 forming an angle θ, relative to a horizontal direction, of at least approximately 105° (see e.g., FIGS. 3-1 and 3-2).

Fixed length leveling link 422 is also provided to facilitate the mechanical self-leveling functions. As was the case with leveling link 322, leveling link 422 includes three pivot attachments. First, leveling link 422 is pivotally attached to lift arm 416 at pivot attachment 414. This pivot attachment 414 can be, in the illustrated embodiment, to telescoping lift arm portion 418, giving the first four-bar linkage two separate variable length links. The second pivot attachment on leveling link 422 is a pivot attachment 420 between leveling cylinder 428 and the leveling link 422. The third pivot attachment on the leveling link 422 is pivot attachment 438 between tilt cylinder 440 and the leveling link 422.

An implement attachment mechanism, in the form of implement interface or carrier 434 is configured to allow a bucket 436 or other implement to be mounted on the lift arm 416. Implement carrier 434 is pivotally attached at a pivot attachment 430 to the telescoping portion of the lift arm. Implement carrier 434 is also pivotally attached, at a pivot attachment 432, to tilt cylinder 440.

As illustrated with respect to lift arm assembly 350-2 shown in FIG. 3-2, leveling cylinder 428 can be hydraulically coupled to the telescoping cylinder or actuator (not shown in FIG. 4) that controls extension and retraction of telescoping portion 418 of lift arm 416. Thus, as the lift arm telescoping actuator extends/retracts to extend/retract telescoping portion 418, leveling cylinder 428 also extends/retracts to create the two variable length links in the first four-bar linkage. The components of the two four-bar linkages are as discussed above with reference to FIG. 3-2.

As shown in FIG. 4, when lift arm 416 is in a fully lowered position and telescoping lift arm portion 418 is retracted within the main lift arm portion, the line of action 462 between lift arm pivot 412 (on frame 410) and pivot 414 of the leveling link 422 (with the lift arm) is close to parallel to the line of action 460 between the leveling cylinder pivot 426 (on frame 410) and pivot 420 of the leveling link 422 (with the leveling cylinder). In exemplary embodiments, the lines of action are within 1 degree of being parallel in this fully lowered position of the lift arm. The angle between these two lines of action 460 and 462 opens up to between 5 degrees and 10 degrees when the lift arm is raised. It must be noted that this geometric configuration, while beneficial in some embodiments, is not required in all embodiments.

As can be seen in FIG. 4, as lift arm 416 is raised, with the tilt cylinder 440 maintained at a fixed length, the length of leveling cylinder 428 does not change but the leveling cylinder 428 pivots about pivots 426 and 420, causing the leveling link 422 to pivot about leveling link/lift arm pivot 414. This will maintain the orientation of bucket 436 relative to the ground or horizontal throughout the range of lift arm motion. Additionally, it can be seen in FIG. 4 that the non-implement carrier pivot 438 for the tilt cylinder 440 moves with respect to the lift arm 416/418. This feature also aids in providing the improved bucket leveling performance of the range of lift arm motion.

Figure 5:
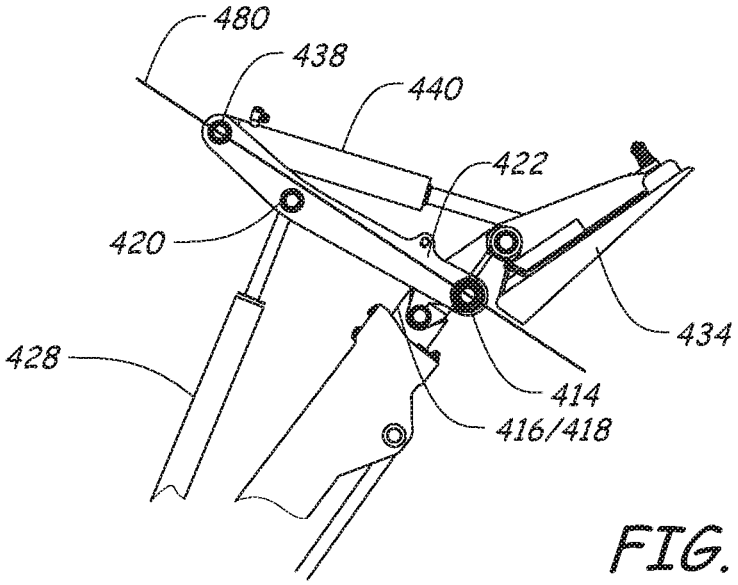
FIG. 5 is a diagrammatic side view illustration of portions of the lift arm assembly and bucket leveling system of FIG. 4, showing pivot positions on a leveling link in an exemplary embodiment.

Referring now to FIG. 5, shown in greater detail are additional features of the lift arm assembly shown in FIG. 4. In exemplary embodiments, it has been found that pivot attachment 420 between the leveling link 422 and the leveling cylinder 428 is optimally positioned behind or rearward (e.g., toward the leveling cylinder pivot 426 and frame 410) of a line of action 480 defined as extending between leveling link pivots 414 and 438. By positioning pivot 420 behind this line of action between the leveling link/lift arm pivot 414 and leveling link/tilt cylinder pivot 438, the packing and arrangement of components (e.g., the size, shape, and physical configuration of implement carrier 434 or an implement in an embodiment without an implement carrier, the tilt cylinder 440, etc.) is made less complex.

Figures 1, 6:
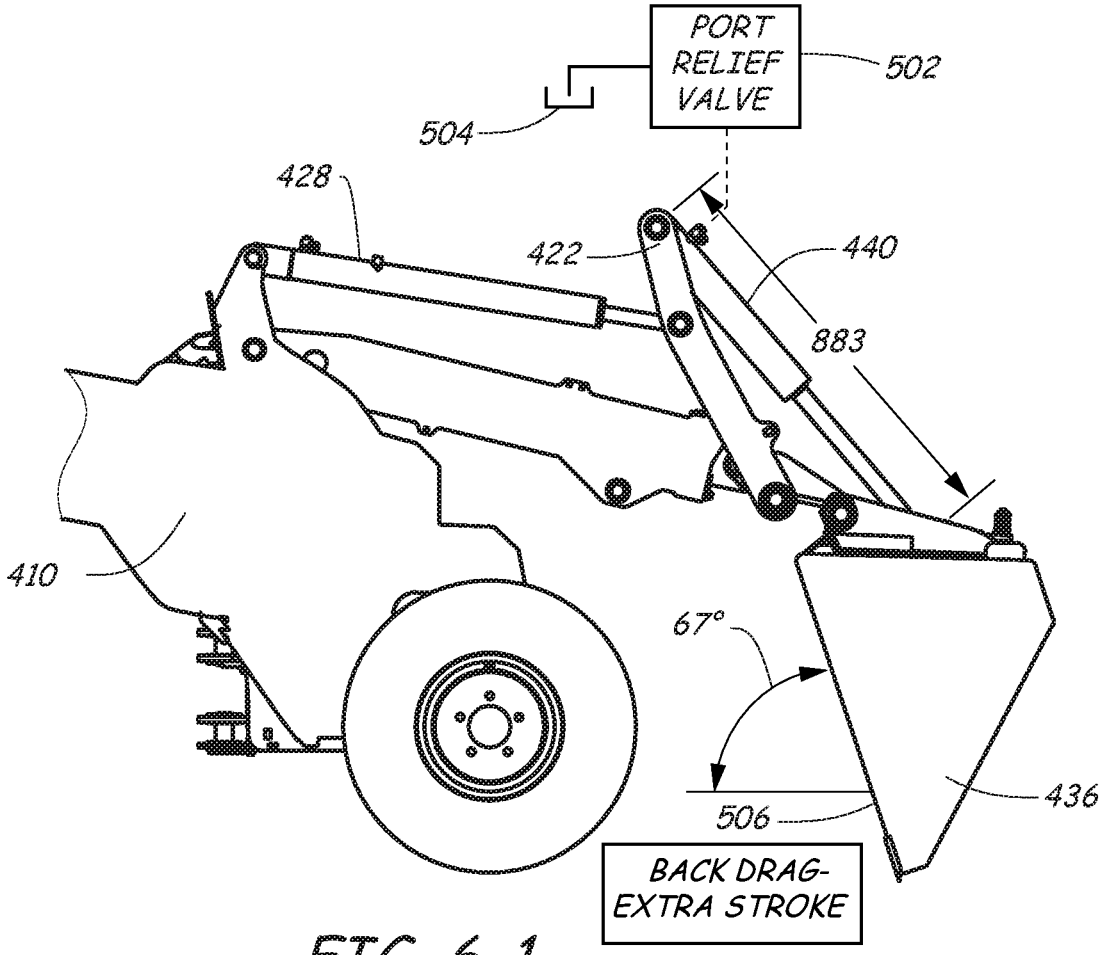
Figures 2, 6:
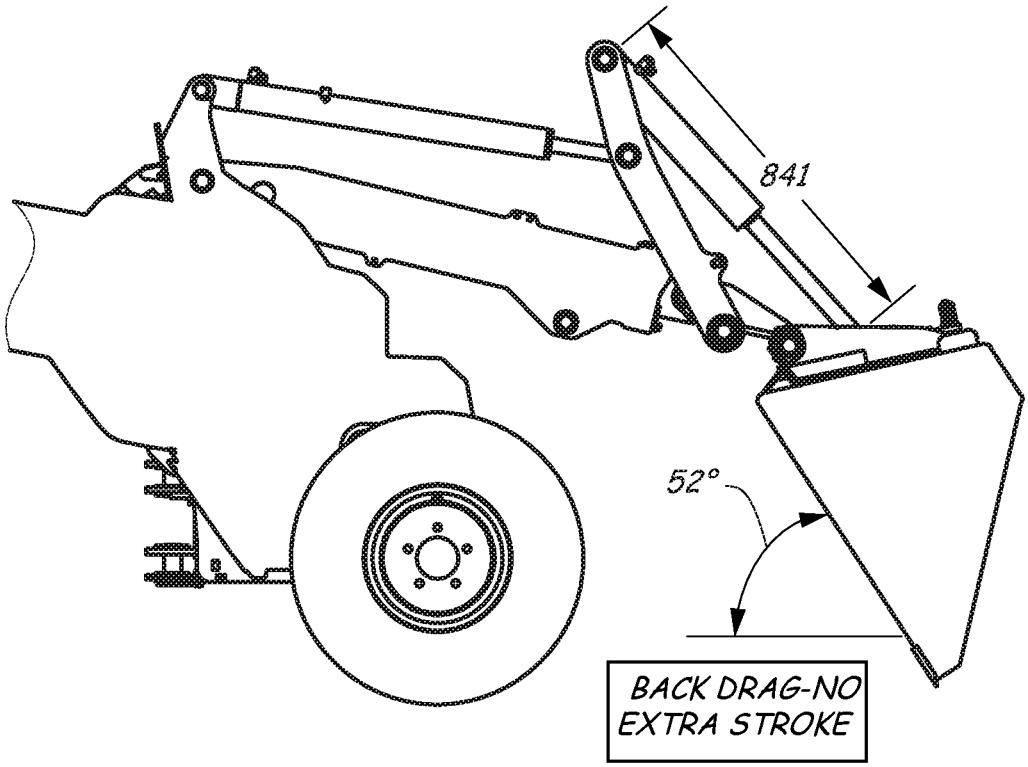

Referring now to FIG. 6-1, shown diagrammatically is another feature of some embodiments of the lift arm assembly shown in FIG. 4. As shown in FIG. 6-1, the lift arm assembly or system can include a tilt cylinder 440 having a long enough stroke to achieve adequate back drag angles. The back-drag angle is defined as the angle formed between bottom 506 of bucket 436 and the ground or horizontal direction. The increased tilt cylinder length allows for a back drag angle of almost 70 degrees. However, having a tilt cylinder with an extra-long stroke can leave the tilt cylinder or other components susceptible to damage when the cylinder is fully extended when the lift arm is in certain positioned. A port relief valve 502 is coupled to tilt cylinder 440 such that pressure within the cylinder 440 is ported to tank 504. The port relief is shown on the base side of tilt cylinder 440, but in other arrangements where the rod side of tilt cylinder 440 is pivotally coupled to leveling link 422, the port relief can be positioned on the rod side of the tilt cylinder instead. Providing the port relief on the tilt cylinder 440 acts to limit the stroke of the tilt cylinder should the tilt cylinder, the bucket, or other attachment encounter an interference with the lift arm. This prevents the tilt cylinder, bucket or other structure (such as the lift arm) from being damaged and allows for additional stroke and for the lift arm to be raised against any contact, between the bucket and a tilt stop, to achieve a better back-drag angle. In comparison, the same lift arm assembly and system, but extended tilt cylinder stroke and without the port relief valve 502, is only capable of achieving a lower back-drag angle-in this example 52 degrees (shown in FIG. 6-2), which is less than a desirable amount.

Although the present invention has been described with reference to preferred embodiments, workers skilled in the art will recognize that changes may be made in form and detail without departing from the scope of the discussion.

What is claimed is:

1. A lift arm assembly of a power machine having an attachment structure for securing an implement thereto, the lift arm assembly comprising:

a lift arm including a main lift arm portion pivotally attached to a frame of the power machine at a first pivot attachment and a telescoping portion that is extendable and retractable relative to the main lift arm portion;

a variable length telescoping link pivotally attached to the frame at a second pivot attachment arranged on the frame;

a fixed length link pivotally attached to the telescoping portion of the main lift arm portion at a third pivot attachment and pivotally attached to the variable length telescoping link at a fourth pivot attachment; and a lift actuator coupled between the frame and the lift arm and selectively operable to raise and lower the lift arm relative to the frame;

wherein the lift arm, frame, variable length telescoping link and fixed length link form a lift arm four-bar linkage with two variable length links.

2. The lift arm assembly of claim 1 and further comprising:

a tilt cylinder pivotally attached to the fixed length leveling link at a fifth pivot attachment; and implement connection points for mounting one of the implement and an implement carrier to the lift arm assembly, including a sixth pivot attachment on the lift arm and a seventh pivot attachment on the tilt cylinder;

wherein the fixed length link, the tilt cylinder, the one of the implement and the implement carrier, and the lift arm form a tilt control four-bar linkage, and wherein the lift arm four-bar linkage and the tilt control four-bar linkage provide mechanical self-leveling of the implement coupled to the lift arm assembly as the lift arm assembly is pivotally raised and lowered relative to the frame.

3. The lift arm assembly of claim 2, wherein the lift arm assembly is configured such that when the main lift arm portion is in a fully lowered position and the telescoping portion is retracted within the main lift arm portion, a first line of action between the first pivot attachment and the third pivot attachment is approximately parallel to a second line of action between the second pivot attachment and the fourth pivot attachment.

4. The lift arm assembly of claim 2, wherein the lift arm assembly is configured such that the fourth pivot attachment is positioned rearward of a line of action extending between the third pivot attachment and the fifth pivot attachment.

5. The lift arm assembly of claim 1, wherein the telescoping portion of the main lift arm is configured to extend and retract relative to the main lift arm portion under power of a telescoping actuator.

6. The lift arm assembly of claim 5, wherein the one of the implement and the implement carrier is pivotally attached to the telescoping portion of the lift arm at the sixth pivot attachment.

7. The lift arm assembly of claim 6, wherein the variable length telescoping link is hydraulically coupled to the telescoping actuator such that the variable length telescoping link extends and retracts as the telescoping portion of the lift arm extends and retracts.

8. The lift arm assembly of claim 7, wherein the variable length telescoping link is a cylinder.

9. The lift arm assembly of claim 1, wherein the second pivot attachment, between the variable length telescoping link and the frame is positioned above and rearward of the first pivot attachment between the lift arm and the frame.

10. The lift arm assembly of claim 1, wherein the second pivot attachment, between the variable length telescoping link and the frame, and the first pivot attachment between the lift arm and the frame, are arranged such that a line of action extending between the first and second pivot attachments forms an angle relative to a horizontal direction of at least approximately 105 degrees.

11. The lift arm assembly of claim 1, and further comprising a port relief valve configured to couple the tilt cylinder to a tank to limit a stroke of the tilt cylinder when one of the tilt cylinder, the implement and an implement carrier encounters interference with the lift arm.

12. A power machine configured to provide mechanical self-leveling of an implement, the power machine comprising:

a frame;

a power source mounted to the frame;

a power conversion system operably coupled to the power source;

a lift arm pivotally attached to the frame at a first pivot attachment;

a lift actuator in communication with the power conversion system and coupled between the frame and the lift arm and the lift actuator selectively operable to raise and lower the lift arm relative to the frame;

a first leveling telescoping link pivotally attached to the frame at a second pivot attachment arranged on the frame;

a second leveling link pivotally attached to the lift arm at a third pivot attachment and pivotally attached to the first leveling telescoping link at a fourth pivot attachment;

a tilt actuator in communication with the power conversion system and pivotally attached at a fifth pivot attachment to the second leveling link; and an implement attachment mechanism configured to mount the implement to the lift arm, so that a combination of the implement and the implement attachment mechanism is pivotally attached to the lift arm at a sixth pivot attachment and pivotally attached to the tilt actuator at a seventh pivot attachment;

wherein the frame, the lift arm, the second leveling link and the first leveling telescoping link form a first four-bar linkage, wherein the second leveling link, the tilt actuator, the implement attachment mechanism and the lift arm form a second four-bar linkage, and wherein the first and second four-bar linkages provide mechanical self-leveling of the implement mounted to the lift arm as the lift arm is pivotally raised and lowered relative to the frame.

13. The power machine of claim 12 wherein one of the first and second four-bar linkages includes two bars with variable lengths.

14. The power machine of claim 12, wherein the lift arm is a telescoping lift arm having a telescoping portion that selectively extends and retracts relative to a main lift arm portion under power of a telescoping actuator.

15. The power machine of claim 14, wherein the implement attachment mechanism is pivotally attached to the telescoping portion of the lift arm at the sixth pivot attachment.

16. The power machine of claim 14, wherein the second leveling link is pivotally attached to the telescoping portion of the lift arm at the third pivot attachment.

17. The power machine of claim 14, wherein the first leveling telescoping link is a variable length leveling link.

18. The power machine of claim 17, wherein the first leveling telescoping link is operably coupled to the telescoping actuator such that the first leveling telescoping link extends and retracts as the telescoping portion of the lift arm extends and retracts.

19. The power machine of claim 18, wherein the first leveling telescoping link is a cylinder.

20. The power machine of claim 14, wherein the lift arm assembly is configured such that when the lift arm is in a fully lowered position and the telescoping portion is retracted within the lift arm, a first line of action between the first pivot attachment, and the third pivot attachment is approximately parallel to a second line of action between the second pivot attachment and the fourth pivot attachment.

21. The power machine of claim 12, wherein the second pivot attachment and the first pivot attachment are arranged such that a line of action extending between the first and second pivot attachments forms an angle relative to a horizontal direction of at least approximately 100 degrees.

22. The power machine of claim 12, wherein the second pivot attachment is positioned above and rearward of the first pivot attachment.

23. The power machine of claim 12, wherein the second pivot attachment and the first pivot attachment are arranged such that a line of action extending between the first and second pivot attachments forms an angle relative to a horizontal direction of between about 100 degrees and 110 degrees.

24. The power machine of claim 12, wherein the lift arm assembly is configured such that the fourth pivot attachment is positioned rearward of a line of action extending between the third pivot attachment and the fifth pivot attachment.

25. The power machine of claim 12, wherein the tilt actuator is a tilt cylinder, and further comprising a port relief valve configured to couple the tilt cylinder to a tank in order to limit a stroke of the tilt cylinder when one of the tilt cylinder and the implement encounters interference with the lift arm.

* * * * *